US010973311B1

(12) United States Patent
Hendricks-Sturrup

(10) Patent No.: US 10,973,311 B1
(45) Date of Patent: Apr. 13, 2021

(54) HAIR BRUSH

(71) Applicant: Rachele Hendricks-Sturrup, Framingham, MA (US)

(72) Inventor: Rachele Hendricks-Sturrup, Framingham, MA (US)

( * ) Notice: Subject to any disclaimer, the term of this patent is extended or adjusted under 35 U.S.C. 154(b) by 0 days.

(21) Appl. No.: 16/682,417

(22) Filed: Nov. 13, 2019

(51) Int. Cl.
*A46B 5/00* (2006.01)
*A46B 9/02* (2006.01)

(52) U.S. Cl.
CPC ..... *A46B 9/023* (2013.01); *A46B 5/0004* (2013.01); *A46B 5/0012* (2013.01); *A46B 5/0041* (2013.01); *A46B 9/026* (2013.01); *A46B 9/028* (2013.01); *A46B 2200/104* (2013.01)

(58) Field of Classification Search
CPC ..... A46B 9/023; A46B 9/026; A46B 9/028; A46B 5/0004; A46B 5/0012; A46B 5/0041; A46B 2200/104
USPC ..... D4/120, 121, 138; 132/132
See application file for complete search history.

(56) References Cited

U.S. PATENT DOCUMENTS

| | | | | | |
|---|---|---|---|---|---|
| 4,423,531 | A * | 1/1984 | Wall | A46B 3/005 | 132/126 |
| 5,865,188 | A * | 2/1999 | Marquez | A45D 2/001 | 132/132 |
| 6,006,395 | A * | 12/1999 | Tiramani | A46B 5/0025 | 15/176.1 |
| 6,477,732 | B1 * | 11/2002 | Cline | A45D 8/30 | 132/121 |
| D471,364 | S * | 3/2003 | Kwong | D4/120 | |
| D525,035 | S * | 7/2006 | McCay | D4/120 | |
| D545,570 | S * | 7/2007 | White | D4/133 | |
| 7,310,849 | B2 * | 12/2007 | White | A45D 20/525 | 15/176.4 |
| D892,415 | S * | 8/2020 | Axelrod | D30/159 | |
| 2007/0174984 | A1 * | 8/2007 | Diamond | A46B 5/0012 | 15/106 |
| 2018/0228265 | A1 * | 8/2018 | Skinner | A46B 5/0004 | |

* cited by examiner

*Primary Examiner* — Randall E Chin
(74) *Attorney, Agent, or Firm* — Fish & Richardson P.C.

(57) ABSTRACT

A hair brush comprising: a first half that includes a first brush head connected to a first handle; a second half that includes a second brush head connected to a second handle; a plurality of first bristles and second bristles attached to the first brush head and the second brush head, wherein the bristles are arranged in multiple groups in which each group includes a second bristle surrounded by multiple first bristles; and a hinge that connects the first half to the second half, wherein the hinge biases the hair brush in an open position.

20 Claims, 3 Drawing Sheets

HAIR BRUSH

TECHNICAL FIELD

This disclosure relates to a hair brush, and more particularly, a hair brush for use with relatively curly hair.

BACKGROUND

Hair brushes can be designed for various types and styles of hair. In some cases, a hair brush can include particular features such that the hair brush is better suited for certain purposes.

SUMMARY

In an aspect, a hair brush includes a first half that includes a first brush head connected to a first handle, a second half that includes a second brush head connected to a second handle, a plurality of first bristles and second bristles attached to the first brush head and the second brush head, wherein the bristles are arranged in multiple groups in which each group includes a second bristle surrounded by multiple first bristles, and a hinge that connects the first half to the second half, wherein the hinge biases the hair brush in an open position.

Implementations can include one or more of the following features.

In some implementations, the first brush head and the second brush head are each comprised of intersecting horizontal lattices and vertical lattices.

In some implementations, the plurality of first bristles and second bristles are attached to inner surfaces of the horizontal lattices and vertical lattices.

In some implementations, the horizontal lattices and the vertical lattices have curved shapes.

In some implementations, the horizontal lattices have a convex shape with respect to inner surfaces to which the first bristles and second bristles are attached.

In some implementations, the vertical lattices have a concave shape with respect to inner surfaces to which the first bristles and second bristles are attached.

In some implementations, the hinge includes a spring that biases the hair brush in the open position.

In some implementations, the first bristles are made from boar hair and the second bristles are made from plastic.

In some implementations, the first handle and the second handle are made from plastic.

In some implementations, the first handle and the second handle include rubber portions to assist with gripping the hair brush.

In some implementations, the first handle and the second handle each includes an indent to assist with gripping the hair brush.

In some implementations, the hair brush is configured to assume a closed position when force is applied to the first handle and the second handle.

In some implementations, a portion of a user's hair is clamped between the first brush head and the second brush head when the hair brush is in the closed position.

In some implementations, hair that resides at or near a center of a surface of the first brush head and the second brush head has relatively more force applied thereto than hair that resides at or near edges of the surface of the first brush head and the second brush head.

In some implementations, the horizontal lattices and the vertical lattices are substantially perpendicular to each other.

In some implementations, spaces are formed between the horizontal lattices and the vertical lattices.

In some implementations, the first bristles are made from a different material than the second bristles.

In some implementations, the first bristles are shorter than the second bristles.

In some implementations, the first bristles are thinner than narrow portions of the second bristles.

In some implementations, the hinge prevents the first half and the second half from opening beyond a predefined angle.

Implementations can provide one or more of the following advantages. In some implementations, the first bristles (e.g., boar hair bristles) are relatively better suited for users with curly hair due to their relative flexibility (e.g., as compared to the second bristles). The boar hair bristles can brush and/or assist in detangling the user's hair without damaging the bristles. Boar hair bristles can also assist in carrying the natural oils of the user's scalp throughout the hair as it is brushed, thereby keeping the hair well-conditioned, and in turn, reducing fizz and static. Boar hair bristles can also assist in stimulating the scalp of the user. The less-numerous plastic bristles can assist in brushing and detangling portions of the hair that are inaccessible by the boar hair bristles, as well as assisting with massaging the scalp. In combination, the two types of bristles spread across the hair brush provide a complete and effective brushing and detangling experience.

By including both vertical and horizontal lattices, the hair brush can sustain increased force that would be expected to be exerted on the hair brush when used with curly and/or thick hair. The shapes of the lattices (e.g., convex for the horizontal lattices and concave for the vertical lattices) allow for different degrees of force to be applied to different portions of the user's hair during brushing and/or detangling. In this way, a portion of the hair can be focused on for each position of the brush during brushing. In other words, the hair that resides towards an inside of the surfaces of the brush heads can experience relatively greater clamping force, while hair that resides towards edges of the surfaces of the brush heads can experience relatively lesser clamping force. However, as the hair brush is passed through the user's hair, all hair eventually experiences the relatively greater clamping force that occurs towards the inside of the surfaces of the brush heads.

The details of one or more embodiments of the invention are set forth in the accompanying drawings and the description below. Other features, objects, and advantages of the invention will be apparent from the description and drawings, and from the claims.

DETAILED DESCRIPTION

Described herein is a hair brush that includes features that are designed for optimal use with users with relatively curly hair. In particular, the hair brush is designed to withstand the force required to pass the brush through curly hair without damaging the brush, all while providing an effective brushing and/or detangling experience.

Figure 1:
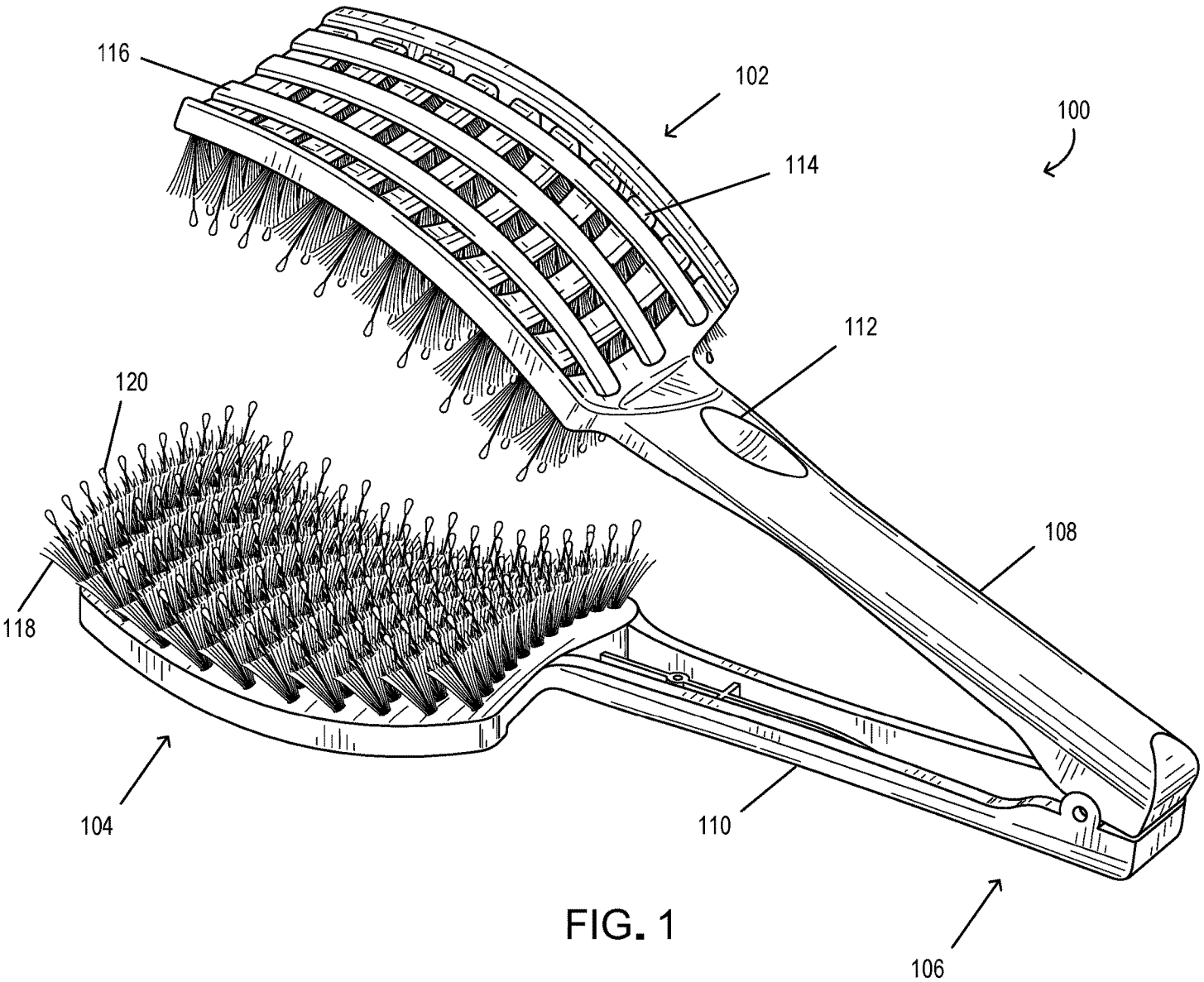
FIG. 1 shows an example of a hair brush.

FIG. 1 shows an example of a hair brush 100 that includes a first half 102 and a second half 104 connected together by a hinge 106. In some implementations, the hinge 106 includes a spring such that the hinge 106 is spring-loaded. The spring may bias the two halves 102, 104 of the hair brush 100 in an open position. In other words, when force is not applied to the two halves 102, 104 of the hair brush 100, the hair brush 100 may be in the open position as illustrated in FIG. 1. The first half 102 includes a first handle 108 and the second half 104 includes a second handle 110. In the illustrated example, the first handle 108 includes an indented portion 112 sized and shaped to accept a finger of a user, for example, at assist in holding the brush steady during brushing. The second handle 110 can also include an indented portion (e.g., the indented portion 312 described below with respect to FIG. 3) to assist in holding the brush steady during brushing. In some implementations, one or both of the first handle 108 or the second handle 110 may include a material that assist with gripping the hair brush 100, for example, a rubber and/or tacky material.

The first half 102 includes a first brush head connected to the first handle 108, and the second half 104 includes a second brush head connected to the second handle 110. Each of the brush heads is formed by intersecting lattices, in particular, a plurality of horizontal lattices 114 and a plurality of vertical lattices 116. Having both horizontal lattices 114 and vertical lattices 116 provides improved rigidity to the hair brush 100 that would not otherwise be provided absent intersecting lattices 114, 116 in substantially perpendicular directions. The spaces between the lattices 114, 116 can allow for air (e.g., warm/hot blown air) to be applied to the hair during brushing.

The lattices 114, 116 include inner surfaces with a plurality of bristles attached thereto. The bristles are arranged in multiple groups across the surfaces of the lattices 114, 116. In particular, each group of bristles includes a plurality of first bristles 118 that surround a second bristle 120. In some implementations, the first bristles 118 and the second bristle 120 are of different types. For example, the first bristles 118 may have sizes, shapes, materials, etc. that are different from the second bristle 120. In some implementations, the first bristles 118 are boar hair bristles and the second bristle 120 is a plastic bristle (e.g., nylon) with a narrow portion and a head portion. The plastic bristle may be longer than the surrounding boar hair bristles. In some implementations, the boar hair bristles are thinner than the narrow portions of the plastic bristles.

In some implementations, the first bristles 118 (e.g., boar hair bristles) are relatively better suited for users with curly hair due to their relative flexibility (e.g., as compared to the second bristle 120). The boar hair bristles can brush and/or assist in detangling the user's hair without damaging the bristles. Due to their improved flexibility, many more boar hair bristles may be provided on the hair brush 100 as compared to the plastic bristles. Boar hair bristles can also assist in carrying the natural oils of the user's scalp throughout the hair as it is brushed, thereby keeping the hair well-conditioned, and in turn, reducing fizz and static. Boar hair bristles can also assist in stimulating the scalp of the user. The less-numerous plastic bristles can assist in brushing and detangling portions of the hair that are inaccessible by the boar hair bristles, as well as assisting with massaging the scalp. In combination, the two types of bristles spread across the hair brush 100 provide a complete brushing and detangling experience.

Figure 2:
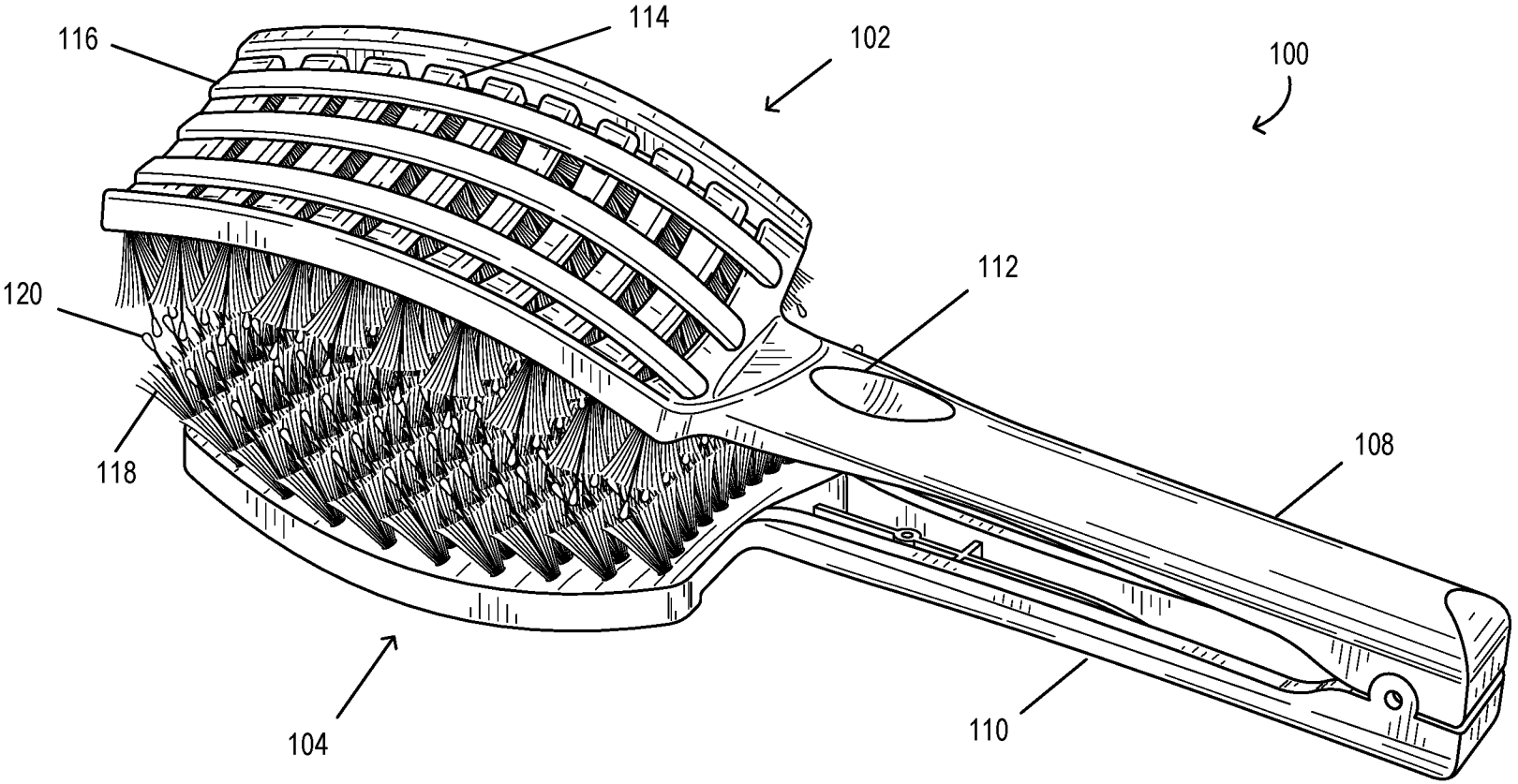
FIG. 2 shows the hair brush of FIG. 1 in a closed position.

The horizontal lattices 114 have a curved shape (e.g., convex shape with respect to the attached bristles) that allows for a portion of hair to be clamped between the two halves 102, 104 of the hair brush 100 when the brush is in the closed position, as illustrated in FIG. 2. Due to the convex shape of the horizontal lattices 114, a portion of hair is clamped between the two halves 102, 104 of the hair brush 100 without clamping all of the hair. Without such a shape, all bristles of the brush would engage the hair brush 100 at the same time, increasing the amount of force required to pass the hair brush 100 through the hair and reducing the effectiveness of the brushing and/or detangling. The apex of the two curved portions of the horizontal lattices 114 make contact with the hair of the user while the surrounding areas at the outer edges of the hair brush 100 make contact with the hair of the user to a lesser extent. In other words, the hair that resides between the outer edges of the hair brush 100 is not fully clamped down, thereby allowing the hair to pass through the brush more easily and evenly during hair brushing and/or detangling.

The vertical lattices 116 also have a curved shape (e.g., a concave shape with respect to the attached bristles) that allows for a portion of the hair to be clamped between the two halves 102, 104 during brushing. The hair that resides at a distal end (e.g., away from the handles 108, 110) of the hair brush 100 and a proximal end (e.g., near the handles 108, 110) of the hair brush 100 is clamped to a greater extent than the hair that resides towards a middle portion of the vertical lattices 116. By engaging some portions of the hair to a greater extent than other portions of the hair, the hair brush 100 can be passed through the user's hair with reduced drag, thereby reducing the amount of force applied to the hair brush 100 during brushing and/or detangling.

The two opposing directions of the horizontal lattices 114 and the vertical lattices 116 result in a variable distribution of clamping pressure applied to the hair across the surface of the lattices 114, 116. Some portions of the hair receive relatively greater clamping pressure, while other portions of the hair receive relatively lesser clamping pressure. However, all portions of the hair eventually receive the increased clamping pressure as the brush is passed through the hair in the closed position of FIG. 2.

Figure 3:
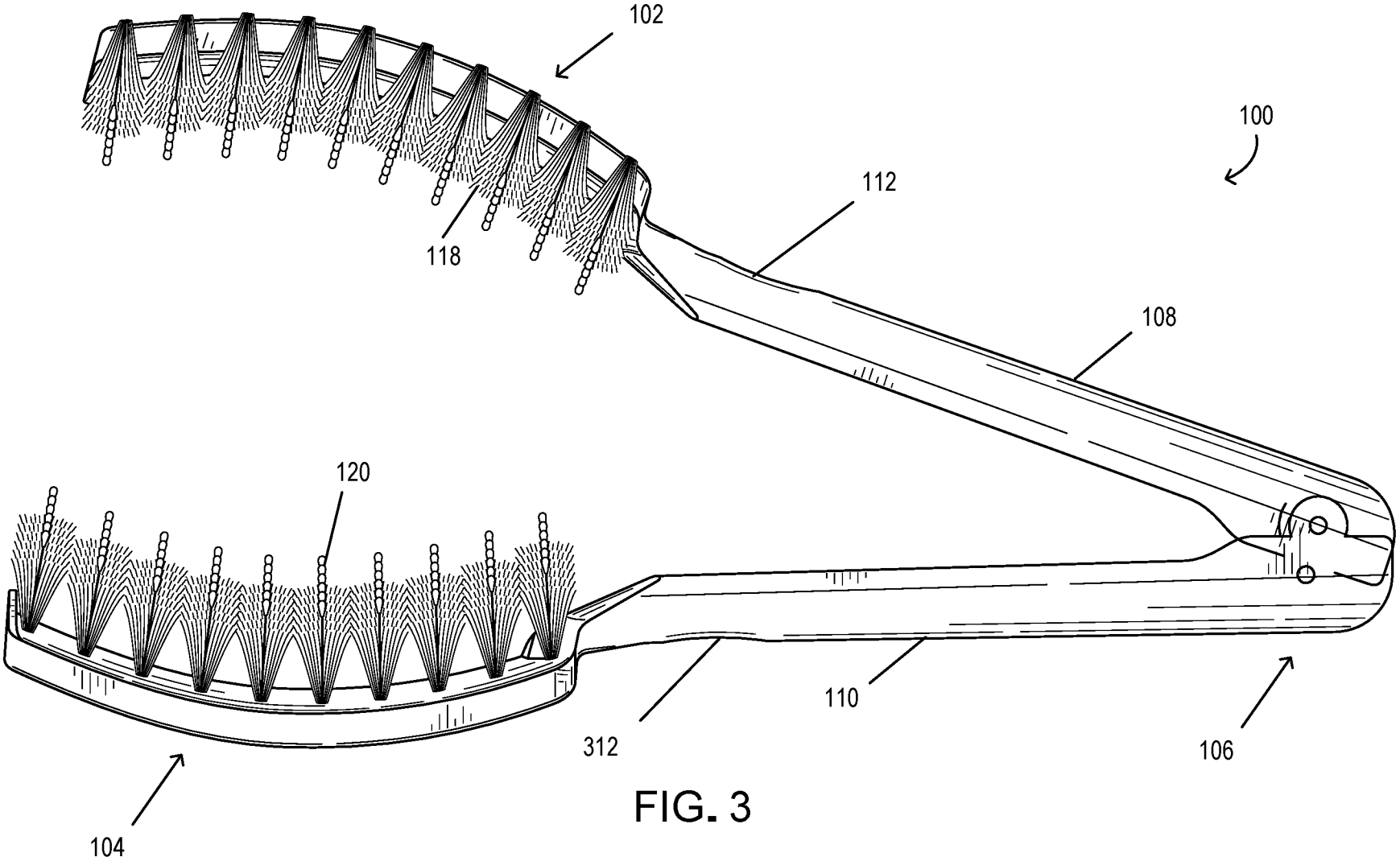
FIG. 3 shows the hair brush of FIGS. 1 and 2 in an open position.

FIG. 3 shows an example of the hair brush 100 in the open position. As described above, the hinge 106 may be spring-loaded to bias the hair brush 100 in the open position when force is not applied to the handles 108, 110. The hinge 106 may include a mechanism for preventing the hair brush 100 from opening beyond a particular angle (e.g., 25-65 degrees in some implementations). Like the first handle 108, the second handle 110 includes an indented portion 312.

In some implementations, the handles 108, 110 may include a mechanism for keeping the hair brush 100 in the closed position during brushing. In this way, a user need not continuously apply pressure to the handles 108, 110 during each brush stroke.

In some implementations, the handles 108, 110 are made of a material that is resilient to pressure, such as plastic. To improve grip, the handles 108, 110 may include one or more rubber portions positioned at locations where the user's hands are intended to grasp the handles 108, 110.

In some implementations, the hinge 106 includes a mechanism to prevent the hair brush 100 from clamping beyond a particular point, thereby preventing a user from applying too much force to the handles 108, 110. The particular point may be chosen to optimize brushing and/or detangling performance by applying a particular degree of force to the hair positioned between the halves 102, 104 of the hair brush 100 without applying force in a degree that makes brushing difficult (e.g., excessive force that prevents the hair brush 100 from passing through the hair).

While particular implementations of the disclosed subject matter have been described, other implementations are within the scope of the following claims.

What is claimed is:

1. A hair brush comprising:

a first half that includes a first brush head connected to a first handle;

a second half that includes a second brush head connected to a second handle;

a plurality of first bristles and second bristles attached to the first brush head and the second brush head, wherein the bristles are arranged in multiple groups in which each group includes a second bristle surrounded by multiple first bristles; and a hinge that connects the first half to the second half, wherein the hinge biases the hair brush in an open position.

2. The hair brush of claim 1, wherein the first brush head and the second brush head are each comprised of intersecting horizontal lattices and vertical lattices.

3. The hair brush of claim 2, wherein the plurality of first bristles and second bristles are attached to inner surfaces of the horizontal lattices and vertical lattices.

4. The hair brush of claim 2, wherein the horizontal lattices and the vertical lattices have curved shapes.

5. The hair brush of claim 4, wherein the horizontal lattices have a convex shape with respect to inner surfaces to which the first bristles and second bristles are attached.

6. The hair brush of claim 4, wherein the vertical lattices have a concave shape with respect to inner surfaces to which the first bristles and second bristles are attached.

7. The hair brush of claim 2, wherein the horizontal lattices and the vertical lattices are substantially perpendicular to each other.

8. The hair brush of claim 2, wherein spaces are formed between the horizontal lattices and the vertical lattices.

9. The hair brush of claim 1, wherein the hinge includes a spring that biases the hair brush in the open position.

10. The hair brush of claim 1, wherein the first bristles are made from boar hair and the second bristles are made from plastic.

11. The hair brush of claim 1, wherein the first handle and the second handle are made from plastic.

12. The hair brush of claim 11, wherein the first handle and the second handle include rubber portions to assist with gripping the hair brush.

13. The hair brush of claim 11, wherein the first handle and the second handle each includes an indent to assist with gripping the hair brush.

14. The hair brush of claim 1, wherein the hair brush is configured to assume a closed position when force is applied to the first handle and the second handle.

15. The hair brush of claim 14, wherein a portion of a user's hair is clamped between the first brush head and the second brush head when the hair brush is in the closed position.

16. The hair brush of claim 14, wherein hair that resides at or near a center of a surface of the first brush head and the second brush head has relatively more force applied thereto than hair that resides at or near edges of the surface of the first brush head and the second brush head.

17. The hair brush of claim 1, wherein the first bristles are made from a different material than the second bristles.

18. The hair brush of claim 1, wherein the first bristles are shorter than the second bristles.

19. The hair brush of claim 1, wherein the first bristles are thinner than narrow portions of the second bristles.

20. The hair brush of claim 1, wherein the hinge prevents the first half and the second half from opening beyond a predefined angle.

* * * * *